US006283900B1

(12) United States Patent
Tornabene

(10) Patent No.: US 6,283,900 B1
(45) Date of Patent: Sep. 4, 2001

(54) EXERCISE APPARATUS

(76) Inventor: Dean Tornabene, 4015 Glenco Ave., Marina Del Rey, CA (US) 90292

( * ) Notice: Subject to any disclaimer, the term of this patent is extended or adjusted under 35 U.S.C. 154(b) by 0 days.

(21) Appl. No.: 09/704,242

(22) Filed: Nov. 2, 2000

(51) Int. Cl.[7] ..... A63B 21/04
(52) U.S. Cl. ..... 482/122; 482/140
(58) Field of Search ..... 482/111, 112, 482/122, 130, 137, 140, 142, 148, 96, 97, 101, 98–100

(56) References Cited

U.S. PATENT DOCUMENTS

| | | | |
|---|---|---|---|
| 4,521,013 | | 6/1985 | Dofel . |
| 4,618,144 | | 10/1986 | Gibson . |
| 4,809,976 | | 3/1989 | Berger . |
| 5,094,450 | | 3/1992 | Stearns . |
| 5,100,131 | * | 3/1992 | Fong ..... 482/112 |
| 5,112,287 | | 5/1992 | Brewer . |
| 5,334,120 | * | 8/1994 | Rasmussen ..... 482/97 |
| 5,575,741 | | 11/1996 | Fan . |
| 5,746,688 | * | 5/1998 | Prager ..... 482/142 |

* cited by examiner

*Primary Examiner*—Glenn E. Richman
(74) *Attorney, Agent, or Firm*—Howard A. Kenyon

(57) ABSTRACT

An exercise apparatus that exercises at least three groups of muscles is disclosed. The apparatus exercises the hamstring muscle, the quadriceps muscle and the maximus gluteus muscle. The apparatus utilizes a seated position for the person exercising and incorporates an elastomeric tension member to provide the resistance. The exercise apparatus incorporates a rectangular backrest. When a person pushes against the backrest, the exercise apparatus rotates lifting the person exercising off the floor surface such that the above three groups of muscles are exercised.

14 Claims, 4 Drawing Sheets

EXERCISE APPARATUS

BACKGROUND OF THE INVENTION

1. Field of the Invention

This invention relates to an exercise apparatus and more particularly the present invention which is directed to an exercise apparatus for the conditioning of the three groups of muscles, the hamstring muscle, the quadriceps muscle and the maximus gluteus muscle.

2. Description of the Prior Art

Many devices exist for exercising various parts of the body for commercial and home use. Some of these devices are:

U.S. Pat. No. 5,575,741 to Robert Fan.

This exercise apparatus simulates horse riding type and rowing type exercise.

U.S. Pat. No. 4,526,013 to W. R. Dofel.

This exercise device provides a mechanical resistance assembly which employs a resistant strap which is stretched by use of a pulley system pulled by the user.

U.S. Pat. No. 5,094,450 to Steams.

This exercise machine provides for abdominal exercising. This machine also allows a chest pod to rotate, which is resisted by either a viscous fluid resistance or stacked weights.

U.S. Pat. No. 5,112,287 to Brewer.

This exercise apparatus employs a resistance that is experienced by a person exerting a force to pull or push the body engaging members. The resistance can be varied.

SUMMARY OF THE INVENTION

It is the object of the present invention to provide an exercise apparatus useful in connection with the performance of exercising at least three groups of muscles.

It is another object of the present invention to exercise the maximus gluteus muscle in addition to two leg muscles.

It is yet another object of the present invention to provide an exercise apparatus that can be efficient and economically manufactured.

Briefly, in accordance with the present invention, there is provided an exercise apparatus that sits on a floor surface and has an rectangular backrest. Two semi-circular members attached to the backrest also sit on a floor surface. Pivotally attached to the backrest is a brace that has a roller resting on the floor surface on the other end. The brace has a sliding member that is fit over the brace and the sliding member is adjusted by push pins. The sliding member adjusts the tension in the tensioning members. Two handlebars are attached to the lower end of the backrest of the exercise equipment When a person exercising pushes back on the backrest, the backrest rotates and lifts the person exercising off the floor surface. The person exercising pushes back as far as desired and then relaxes and the person exercising will return to sit on the floor surface. This movement is repeated until a complete workout is obtained in the three previously mentioned muscle groups. It is noted that a person exercising must hold their feet flat on the floor. A person exercising must also have non-slip shoes such as gym shoes to provide the ability to push back on the backrest of the exercise equipment.

These and other objects, features and advantages of the present invention will become more readily apparent upon detail consideration of the following Description of the Preferred Embodiment with reference to the accompanying drawings.

DESCRIPTION OF THE DRAWINGS

In the drawings that illustrate the best mode presently contemplated for carrying out the present invention are.

The novel features which are believed to be characteristic of the invention, both as its organization and its method of operation, together with further objects and advantages thereof, will be better understood from the following description in connection with the accompanying drawings in which a presently preferred embodiment of the invention is illustrated by way of example. It is expressly understood, however, that the drawings are purposes of illustration and description only, and are not intended as a definition of the limits of the invention.

DESCRIPTION OF THE PREFERRED EMBODIMENT

Figure 1:
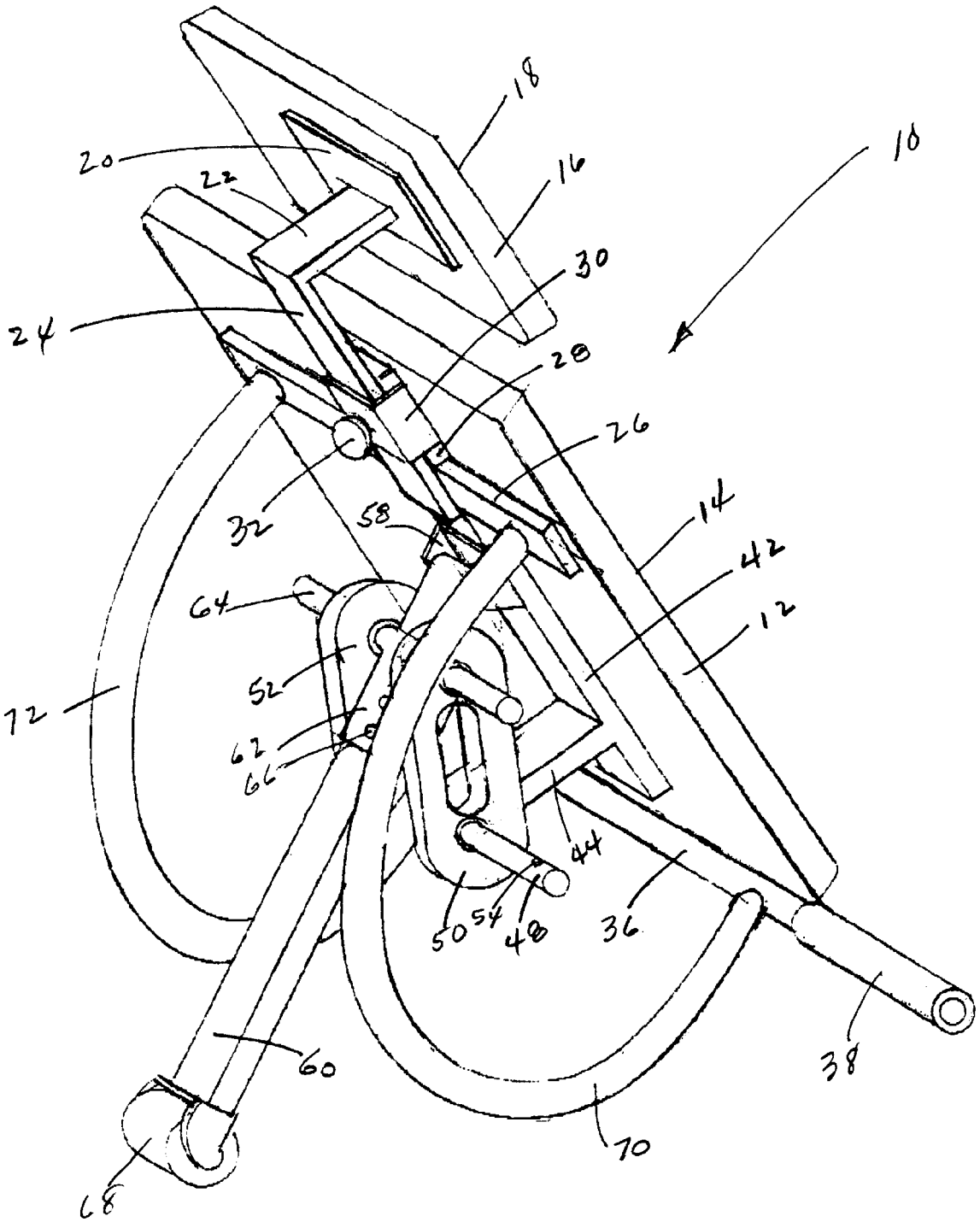
FIG. 1 is an isometric view showing the back of the present invention.

Turning now to FIG. 1 there is seen a perspective view of the present invention generally shown as 10. The backrest 12 made of a solid material has cushioning material on the front side which is also covered with a waterproof material 14. The headrest 16, also made of solid material, is covered with a cushioning material and also covered with a waterproof material 18. The headrest 16 has a structural member 20 attached to the back of the headrest 16. The structural member 20 has attached thereto a structural member 22 that is further attached at 90 degrees to another structural member 24. The backrest 14 has attached a horizontal structural member 26 which has a vertical structural member 28 attached only to the horizontal structural member 26. Vertical structural member 28 is not attached to the backrest 14. A bracket 30 is fitted around both structural member 24 and structural member 28 whereby structural member 24 may slide up or down to adjust to the requirement of the person exercising. Once the adjustment is made, thumb screw 32 can be tightened to hold the headrest in place.

Also attached to the backrest 12 is rod 36 which has attached thereto hand holds 38 and 40. (Seen in FIGS. 3 and 4). The backrest 12 has attached a vertical structural member 42 which has a horizontal structural member 44 attached 90 degrees to vertical structural member 42. Attached to horizontal structural member 44 is a rod 48 that holds one end of elastomer members 50 and 52. Bar 48 has push pins 54 and 56 (not shown) to prevent the elastomer members 50 and 52 from coming off rod 48. Vertical structural member 42 has affixed thereto a bracket 58 that pivotally holds a brace 60. Brace 60 has a sleeve 62 that slides along brace 60. Sleeve 62 has affixed thereto rod 64 that holds one end of elastomer members 50 and 52. Sleeve 62, when slid along brace 60, provides tensioning of elastomer members 50 and 52. The adjustment is held in place by push pins protruding through a hole in sleeve 62.

On the bottom end of brace 60 there is a roller 68 that rolls on the same floor surface that backrest 12 sits. FIG. 1 also shows semi-circular members 70 and 72 that are covered with a non-slip material. Semi-circular member 70 and 72 also sit on the same floor surface that the backrest 12 sits.

Figure 2:
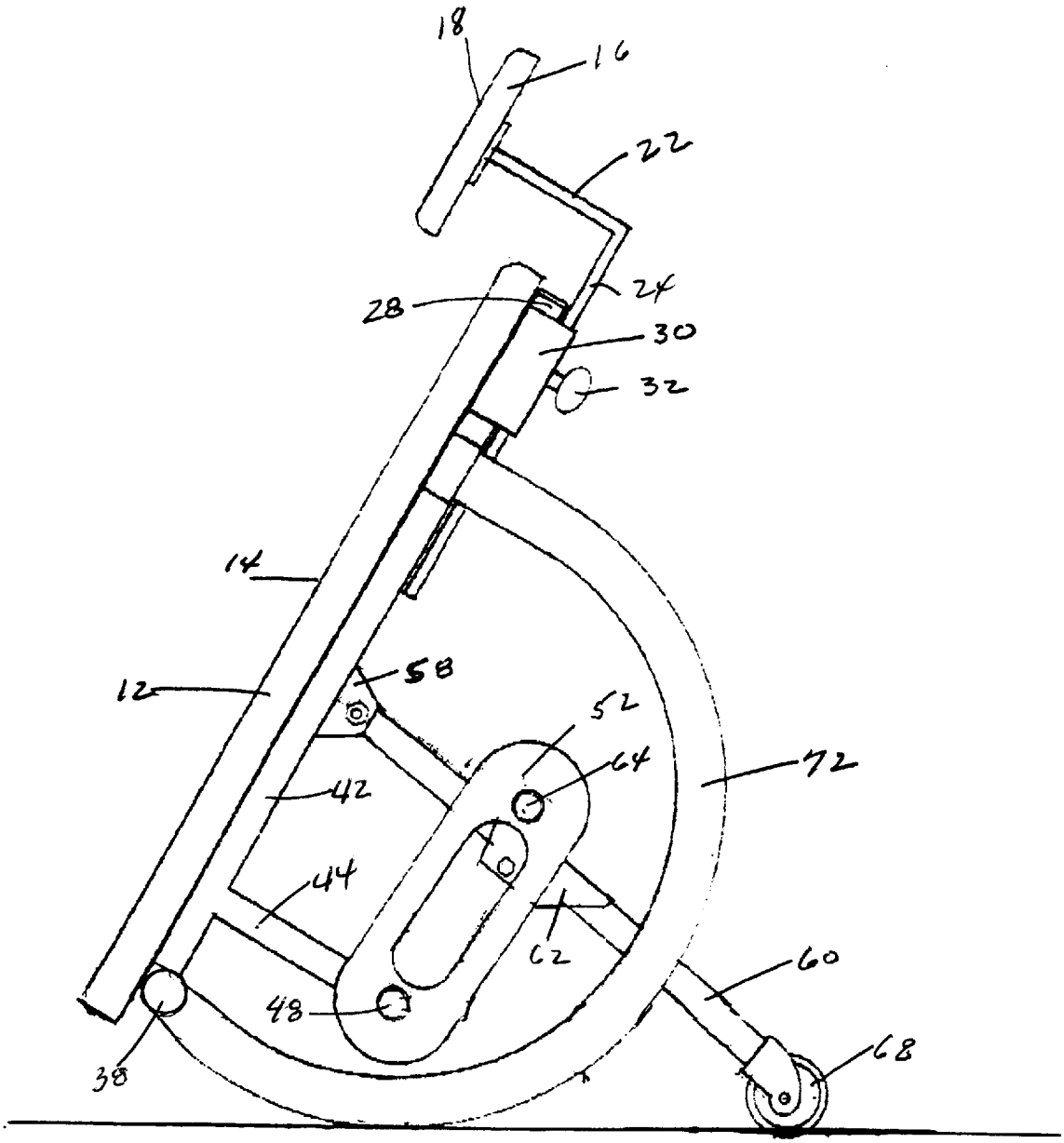
FIG. 2 is a left side view of the present invention.

FIG. 2 shows a left side view of the present invention. The right side is a mirror image.

Figure 3:
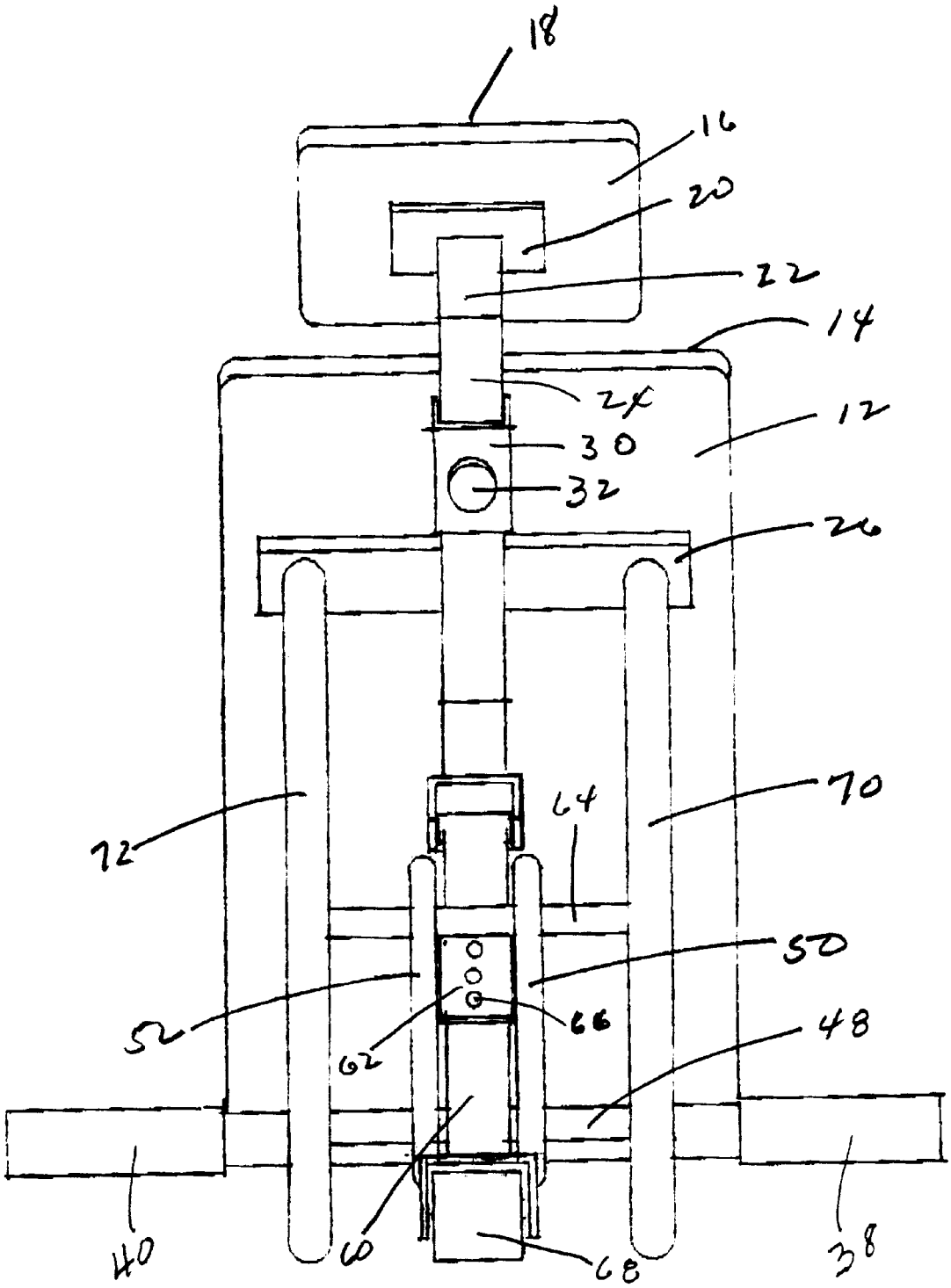
FIG. 3 is a rear view of the present invention.

FIG. 3 shows a back side of the present invention.

Figure 4:
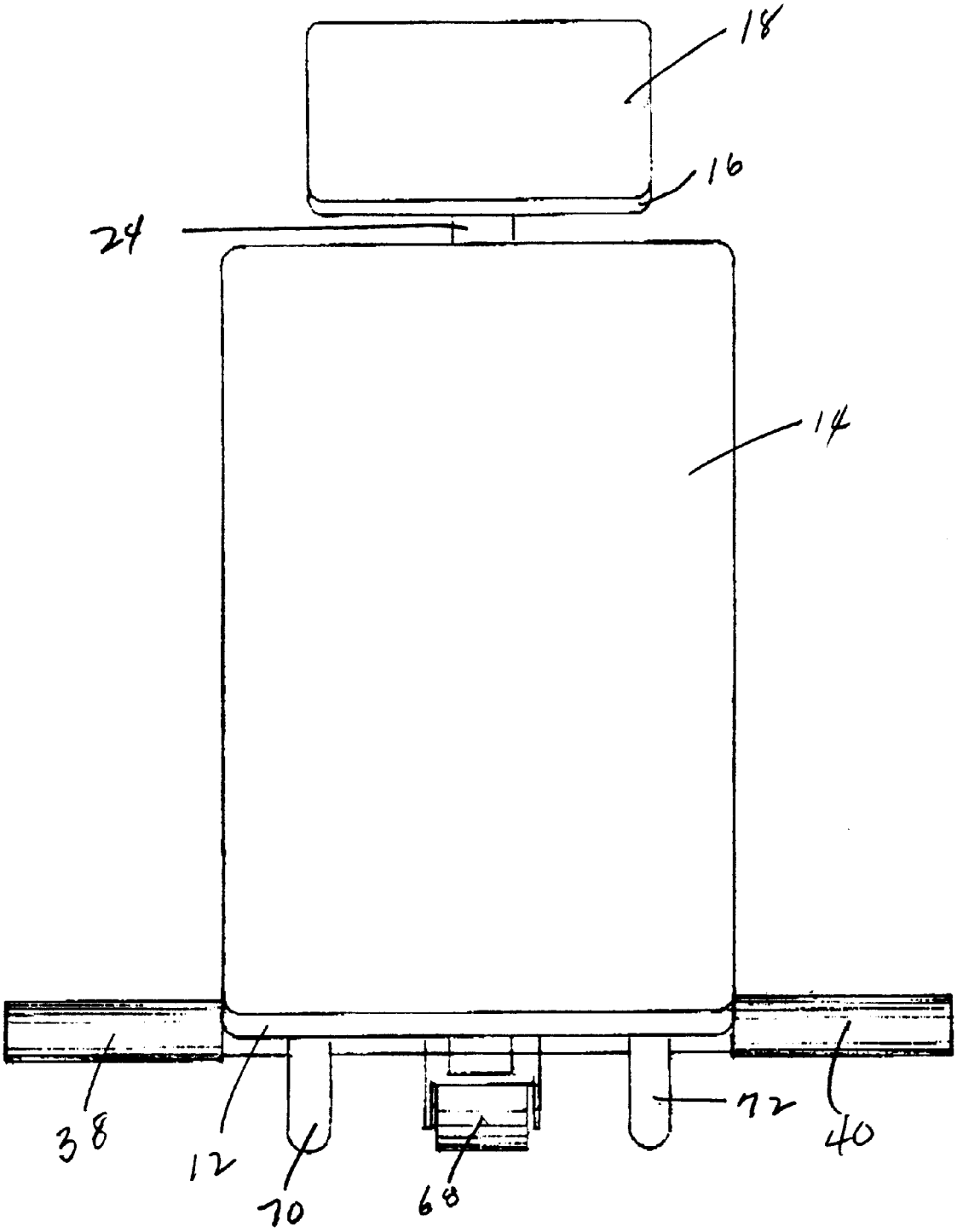
FIG. 4 is a front view of the present invention.

FIG. 4 shows the front side of the present invention.

The operation of the exercise apparatus is very easy. When the person exercising sits on the floor surface where the backrest sits and puts their hands on the hand holds 38 and 40, the person exercising then places their back on the backrest and their head on the headrest. The person exercising then pushes back with their back and the exercise apparatus rotates on the semi-circular members 70 and 72. Simultaneously roller 68 rolls on the floor surface and this motion provides a tension in elastomer members 50 and 52. The motion of pushing back by the person exercising lifts the person exercising off the floor surface and the rotation of the exercise apparatus on the floor surface increases the tension in the elastomer members 50 and 52. This movement of the person exercising exercises the three groups of muscles previous indicated. When the person relaxes the exercise apparatus returns to the initial position. This movement is repeated until a complete workout is obtained.

The present disclosure includes that contained in the appended claims as well as that of the aforegoing description. Although this invention has been described in this preferred form, with a certain degree of particularity, it is understood that the present disclosure of the preferred form has been made by way of example and that numerous changes in the details of construction and the combination and arrangement of parts maybe resorted to without departing from the spirit and scope of the invention.

What is claimed is:

1. An exercise apparatus for exercising, at least, the hamstring muscle, the quadriceps muscle and the maximus gluteus muscle comprising:

a rectangular backrest having a front side and a back side;

a headrest attached to said back side of said rectangular backrest, said headrest having a front side and a back side;

handles connected to said back side of said backrest;

two semi-circular members, said semi-circular members being covered with a non-slip material;

a horizontal structural member attached to said back side of said rectangular backrest;

a vertical structural member attached to said back side of said rectangular backrest, said vertical structural member further attached on one end to said horizontal structural member;

a brace member, said brace member being pivotally attached on one end to said vertical structural member;

tensioning members having a first end and a second end, said first end attached to a first rod and said second end attached to a second rod.

2. An exercise apparatus as described in claim 1 wherein said rectangular backrest and said headrest has cushioning material attached thereto on front side of said rectangular backrest and said front side of said headrest, said cushioning material being covered with a waterproof covering.

3. An exercise apparatus as described in claim 1 wherein said semi-circular members are attached 90 degrees to said backrest, one end of said semi-circular member being attached to said handles and one end of said semi-circular members being attached to said horizontal structural member which is further attached to said backrest.

4. An exercise apparatus as described in claim 1 wherein said brace member being pivotally attached to said vertical structural member on one end and said brace member having roller means on one end.

5. An exercise apparatus as described in claim 1 wherein said vertical structural member is attached to said backrest and has a horizontal structural member that is permanently attached to said vertical member at 90 degrees, said horizontal structural member being also attached to one end of a bar holding an end of said tensioning members, said bar having a push pin on each end to keep said tensioning member from coming off of said bar.

6. An exercise apparatus as described in claim 1 wherein said brace member has attached thereto a sliding member fitted over said brace member, said sliding member having push pins means for adjustment of said tensioning members.

7. An exercise apparatus as described in claim 6 wherein said sliding member has attached thereto a bar holding an end of said tensioning members.

8. An exercise apparatus as described in claim 1 wherein said headrest has a structural member attached to said headrest, said structural member of said headrest providing vertical adjustment of said headrest by sliding said structural member of said headrest vertically between a bracket and said vertical structural member, said bracket having a screw that is tightened when a person exercising obtains the correct position.

9. An exercise apparatus as described in claim 4 wherein said roller means is sufficiently large to roll either on a hard surface or a soft surface, said roller being placed on the floor surface.

10. An exercise apparatus as described in claim 1 wherein a person exercising sits on a floor surface and places their back on said front side of said backrest, said person exercising placing their feet on the floor, said person exercising placing their hands on said handles, said person exercising pushing with their back backward on said front side of said backrest, said person exercising rotating said exercise apparatus which in turn will lift said person exercising off of said floor surface, said person rotating said exercise apparatus to a selected position.

11. An exercise apparatus as described in claim 10 when said person exercising relaxes which in turn will allow said exercise apparatus to reverse and place said person exercising back on said floor surface.

12. An exercise apparatus as described in claim 10 wherein said person rotating said exercising apparatus to a selected position will exercise said hamstring muscles, said quadricep muscles and said maximus gluteus muscles.

13. An exercise apparatus as described in claim 1 wherein said tensioning members are attached on said first end to said first rod and said first rod is attached to said horizontal structural member, said horizontal structural member being attached to said vertical structural member at 90 degrees, said vertical structural member being attached to said backrest.

14. An exercise apparatus as described in claim 1 wherein said tensioning members are attached on said second end to said second rod, said second rod being attached to said sliding member, said sliding member being fitted over said brace member, said brace member being pivotally attached to said vertical member on one end, said brace member having said roller means on one end, said roller means being in contact with said floor surface, said roller means rolling on said floor surface when said person exercising pushes with their back on said front side of said backrest which results in a resistance in said tensioning members.

* * * * *